US006540597B1

(12) United States Patent
Ohmori

(10) Patent No.: US 6,540,597 B1
(45) Date of Patent: Apr. 1, 2003

(54) POLISHING PAD CONDITIONER

(75) Inventor: Hitoshi Ohmori, Wako (JP)

(73) Assignee: Riken (JP)

( * ) Notice: Subject to any disclaimer, the term of this patent is extended or adjusted under 35 U.S.C. 154(b) by 24 days.

(21) Appl. No.: 09/643,257

(22) Filed: Aug. 22, 2000

(30) Foreign Application Priority Data

Aug. 25, 1999 (JP) ..... 11-237745

(51) Int. Cl.[7] ..... B24B 21/18

(52) U.S. Cl. ..... 451/443; 451/8; 451/56; 451/72; 451/527

(58) Field of Search ..... 451/56, 72, 443, 451/527, 548

(56) References Cited

U.S. PATENT DOCUMENTS 6,293,854 B1 * 9/2001 Kimura et al. ..... 451/56
6,306,025 B1 * 11/2001 Torii ..... 451/443

FOREIGN PATENT DOCUMENTS

WO WO98/55265 A1 12/1998

* cited by examiner

*Primary Examiner*—Joseph J. Hail, III
*Assistant Examiner*—Alvin J. Grant
(74) *Attorney, Agent, or Firm*—Griffin & Szipl, P.C.

(57) ABSTRACT

The polishing pad conditioner incorporates a plurality of diamond prisms 12 arranged regularly and protruding towards a surface to be processed, and a conducting bonding member 14 that fixes the diamond prisms into a single body. The conducting bonding member 14 is provided with a conducting metal plate 15 with a plurality of holes 15*a* for embedding the diamond prisms 12, and a conducting sintered metal 16 that is filled into the spaces between the holes and the diamond prisms and sintered. The conducting bonding member can be dressed electrolytically by passing a flow of conducting liquid 24 through the gap between the member and an electrode placed opposite. Thus, the surface of a polishing pad can be reprocessed (reconditioned) to an appropriate roughness, so the conditioner can continue to operate under even, stable conditions for a very long time, with a rather low manufacturing cost and without contaminating the silicon wafers.

4 Claims, 4 Drawing Sheets

POLISHING PAD CONDITIONER

BACKGROUND OF THE INVENTION

1. Technical Field of the Invention

The present invention relates to a polishing pad conditioner that conditions a polishing pad.

2. Prior Art

FIG. 1 is a schematic view showing a CMP apparatus (Chemical Mechanical Polishing Apparatus) used in a final process for producing deviced/bare silicon wafers. The CMP apparatus is composed of a rotating base plate 3 with a polishing pad 2 mounted thereon, and a rotating plate 4 on the lower surface of which a silicon wafer 1 is fixed; while the rotating base plate 3 and the rotating spindle 4 are rotated around their respective axes, a slurry 5 containing colloidal silica is fed between the plate 3 and spindle 4, and super-fine particles of $SiO_2$ (with grain diameters of several nanometers to several tens of nanometers) in the colloidal silica react with the silicon wafer (Si) and this softens the particles, and at the same time, the lower surface of the silicon wafer 1 is polished by the $SiO_2$ in the colloidal silica retained on the polishing pad.

The upper surface of the polishing pad 2 used in the CMP apparatus should have an appropriate roughness so that a preferred amount of slurry 5 is held in the space between the pad and the silicon wafer 1 and a suitable amount of friction is produced between the pad and the silicon wafer 1. However, when the CMP apparatus is used continuously, the roughness of the upper surface of the polishing pad is gradually lost, and the surface becomes slippery like a mirror, and eventually the polishing rate is greatly reduced and efficient polishing can no longer be performed.

Therefore, the surface of the polishing pad must be reprocessed (in a process called conditioning) to restore the appropriate roughness, and a polishing pad conditioner, an example of which is shown in FIGS. 2A and 2B, has conventionally been used.

FIG. 2A shows an electrodeposition grindstone in which the abrasive grains 8 (for instance, diamond abrasive grains with a grain diameter of several tens of microns) are fixed to the lower surface of a base metal 6 by a plated layer 7 of Ni etc. However, this polishing pad conditioner used to suffer from the fact that the abrasive grains 8 could be attached by only one layer of plating and the strength with which they were held by the metal plating was low. Consequently, because some of the abrasive grains 8 come off, the life is short and the operation can only be repeated a few times. And moreover, the detached abrasive grains are left on and become embedded in the polishing pad (which is for instance, made of a plastic material), with the problem that the silicon wafer 1 is damaged. Another problem was that due to the residue of heavy metal remaining after the plating process, the high-purity silicon wafer 1 was contaminated.

FIG. 2B shows another polishing pad conditioner in which the lower surface of the base metal 6 is formed with an appropriate roughness in advance, and then its surface is coated with a thin diamond film 9 by CVD (Chemical Vapor Deposition). Although the thin film 9 of this polishing pad conditioner provides a high adhesive force, the time taken to grow the film is so long that the manufacturing cost is extremely high and this is a practical problem. In addition, there are other problems with this conditioner including the difficulty in obtaining a uniform film thickness and the short life due to the extremely thin film (several tens of microns).

SUMMARY OF THE INVENTION

The present invention aims at solving the various problems described above. More explicitly, the objects of the present invention are to provide a polishing pad conditioner that can reprocess (condition) the surface of a polishing pad so as to give it an extremely long life, that is capable of maintaining an even conditioning power, with a rather low manufacturing cost, and without the risk of contaminating the silicon wafer.

As modern science and technology have made great advances, the requirements for ultra-high-precision processing have rapidly become more and more rigorous, and for example, the Electrolytic In-process Dressing (ELID) process was developed by the applicants of the present invention and has been disclosed (Institute of Physical and Chemical Research, Symposium "Trends in Advanced Technologies for Mirror Surface Polishing," held Mar. 5, 1991).

According to this ELID method, a conducting grindstone is used in place of the electrode used in conventional electrolytic grinding, and an electrode is provided opposite the grindstone with a gap between them, and while a conducting liquid flows between the grindstone and the electrode, a voltage is applied between the grindstone and the electrode, and by dressing the grindstone with the electrolyte, the workpiece is ground by the grindstone. With this ELID grinding method, even if the abrasive grains are fine, loading of the grindstone is prevented due to the electrolytic dressing, therefore by using the abrasive grains finer, a very excellent processed surface such as a mirror surface can be produced by the ELID grinding process. Consequently, it is expected that the ELID method will be applied to various grinding processes, because with this method, the sharpness of the grindstone can be maintained from high-efficiency grinding to mirror-surface grinding, and a highly accurate surface that could not be produced by conventional technologies can be created in a short time.

The present invention is aimed at greatly improving the performance of a polishing pad conditioner using the principles of this ELID method. In detail, in the present invention, a plurality of diamond prisms (12) are arranged so as to project towards a surface to be processed, and a conducting bonding material (14) fixes the aforementioned diamond prisms into a single body; the above-mentioned conducting bonding material can be dressed electrolytically by making a conducting liquid (24) flow in the gap between the bonding material and an electrode (22) opposite the bonding material.

According to the aforementioned configuration of the present invention, because the conducting bonding material (14) that fixes the diamond prisms into a single body can be dressed electrolytically with the flow of conducting liquid (24) to the electrode (22) placed opposite the body, when the tips of the diamond prisms (12) wear resulting in a reduced protrusion thereof from the conducting bonding material and a deterioration in the conditioning capability, an amount of the material is removed from the surface thereof by electrolytic dressing, thereby increasing the amount by which the diamond prisms protrude from the surface. Accordingly, the amount of protrusion can be optimized at all times, so the tips of the diamond prisms can always function as cutting edges, therefore a polishing pad (made of a plastic material, for instance) can be reconditioned to an appropriate roughness, hence the conditioning performance can be maintained at a stable, uniform level. In addition, since artificial prismatic diamonds with a length of about 2 mm can be used as the diamond prisms, the life is several tens of times as long as those of conventional abrasive grains or thin-film conditioners.

According to a preferred embodiment of the present invention, the above-mentioned conducting bonding material (14) is composed of a conducting metal sheet (15) with a plurality of holes (15*a*) in which the diamond prisms (12) are embedded, and a conducting sintered metal (16) is filled into the gap between the aforementioned holes and the diamond prisms and sintered.

According to this configuration, the diamond prisms (12) are inserted into the holes (15*a*), and a conducting metal powder is placed in the gaps and sintered, thus a conducting sintered metal (16) that firmly holds the diamond prisms (12) can be formed, so compared to the slow-growing, expensive CVD method, the manufacturing cost can drastically be reduced. In addition, because the metal powder can be sintered while being maintained at a high temperature in an inert gas environment, there is no risk of impurities getting mixed in, therefore the silicon wafer can be protected from contamination.

The above-mentioned conducting bonding material (14) is shaped as a circular disk, and tips of the aforementioned plurality of diamond prisms are located on the bottom surface of the disk. The material in this configuration can be used as a circular-disk-type polishing pad conditioner.

Other objects and advantages of the present invention are revealed in the following description referring to the attached drawings.

DESCRIPTION OF PREFERRED EMBODIMENTS

Figure 1:
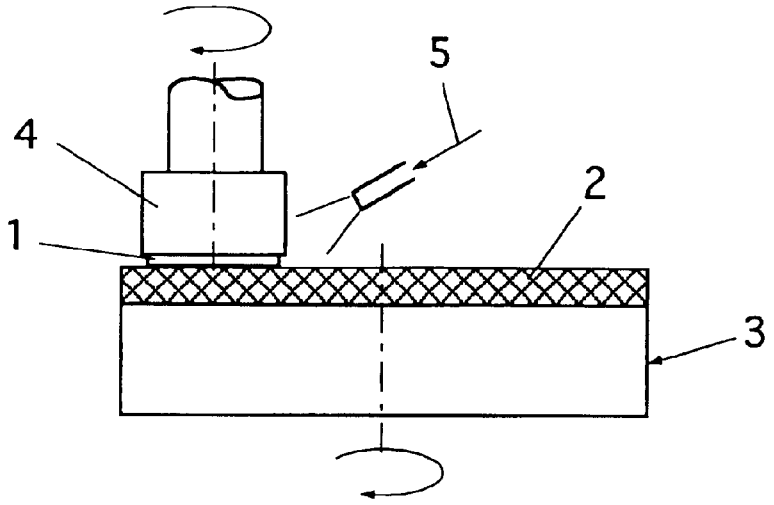
Fig.1 (Prior Art)
FIG. 1 is a diagram showing a conventional CMP apparatus.
Figure 2A:
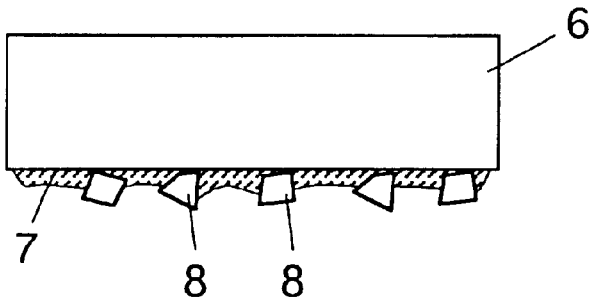
Fig.2A (Prior Art)
FIGS. 2A and 2B are diagrams showing conventional pad conditioners.
Figure 2B:
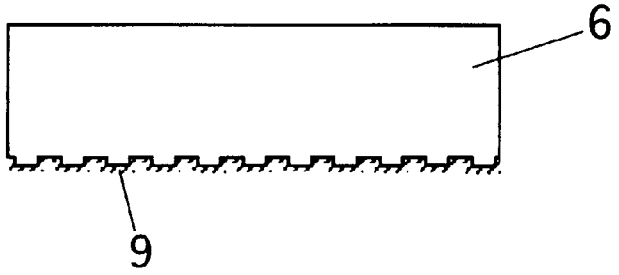
Fig.2B (Prior Art)

Preferred embodiments of the present invention are described below referring to the drawings. The same part numbers are used in all the drawings to indicate the same parts, and no duplicate description is given.

Figure 3A:
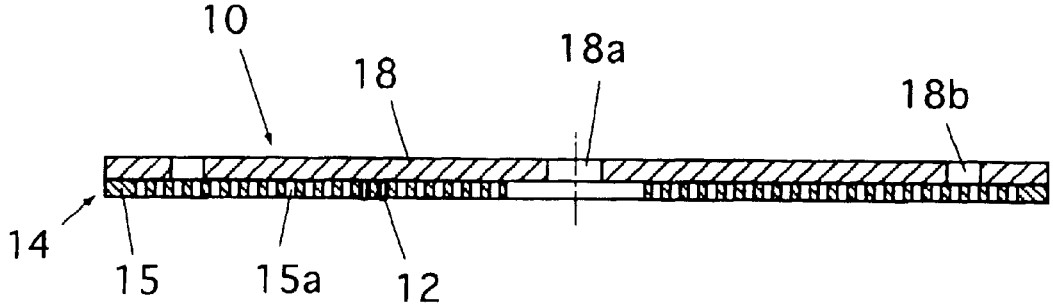
FIGS. 3A and 3B are diagrams of a polishing pad conditioner according to the present invention.
Figure 3B:
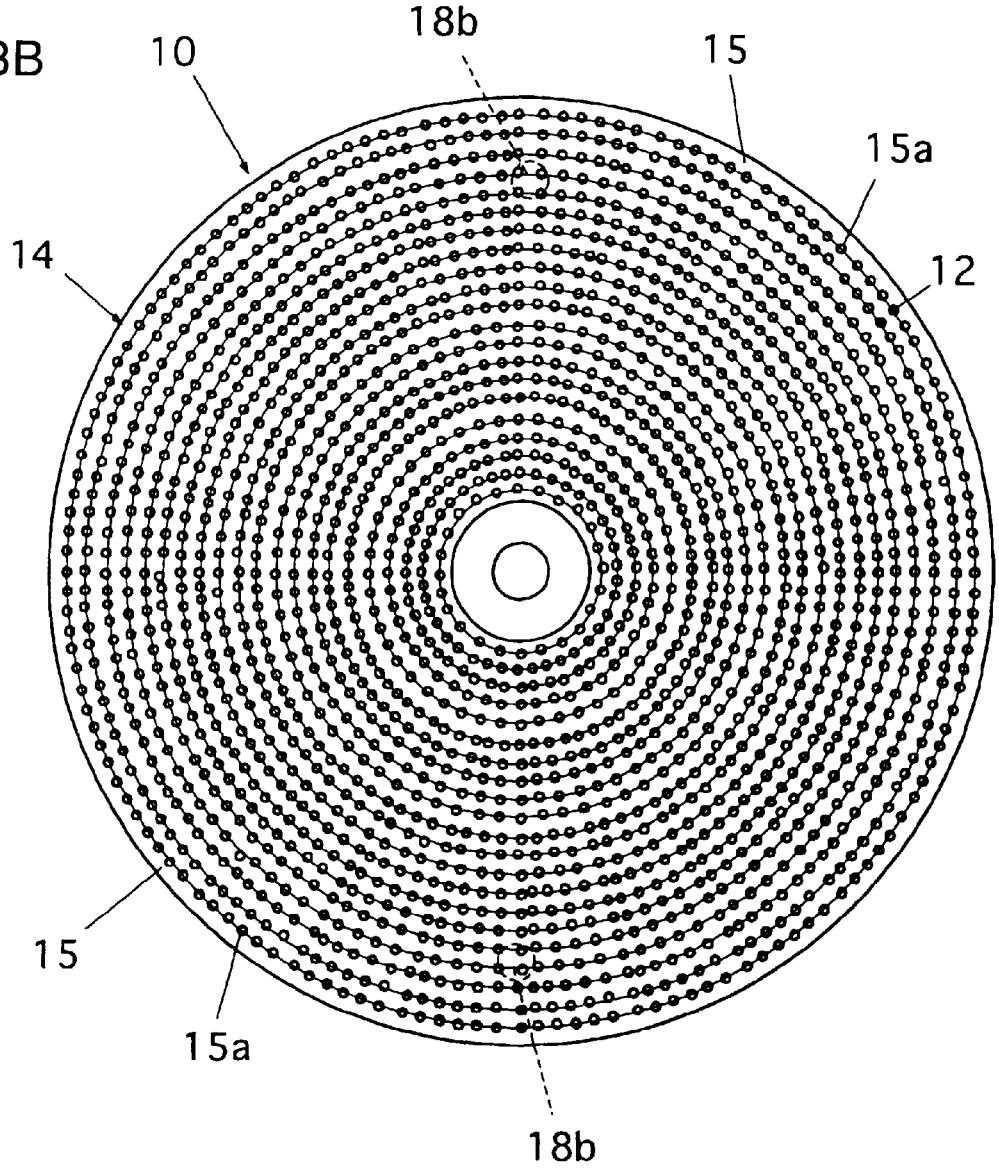

FIGS. 3A and 3B are diagrams showing the polishing pad conditioner according to the present invention. FIG. 3A is a section through the conditioner, and FIG. 3B a view of the bottom. As shown in these figures, the polishing pad conditioner 10 according to the present invention is composed of a plurality of diamond prisms 12 arranged regularly, protruding towards a surface to be processed (bottom surface in the figures), and the conducting bonding member 14 that fixes the diamond prisms 12 into a single body. The conducting bonding member 14 is a circular disk in shape according to this embodiment, and the plurality of diamond prisms 12 are distributed evenly on the lower surface of the circular disk. In this embodiment, about 2,000 prisms are embedded, the tips of which are positioned on the bottom surface of the disk.

Figure 4A:
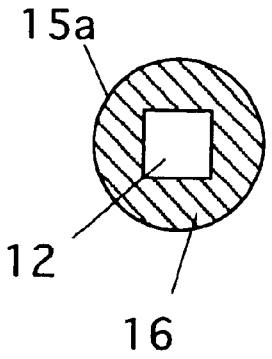
FIGS. 4A and 4B show parts of the polishing pad conditioner related to FIGS. 3A and 3B.
Figure 4B:
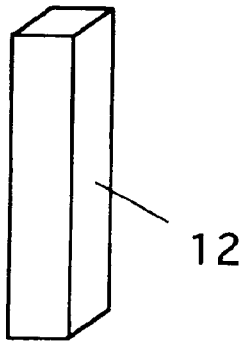

FIGS. 4A and 4B show component parts of the polishing pad conditioner shown in FIGS. 3A and 3B. FIG. 4A is an enlarged view of a diamond prism 12 in FIG. 3B, and FIG. 4B is an isometric view of a single diamond prism 12.

The diamond prism 12 in FIG. 4B, used in this embodiment, is an artificial prismatic diamond with a square form with sides of about 0.2 mm and about 2 to 2.5 mm in length. Such artificial prismatic diamonds are presently being mass produced at relatively low costs.

As shown in FIGS. 3A, 3B and 4A, the conducting bonding member 14 is composed of a conducting metal sheet 15 with a plurality of holes 15*a* in which the diamond prisms 12 are embedded, and a conducting sintered metal 16 is filled into the gaps between the holes 15*a* and the diamond prisms 12 and sintered.

The polishing pad conditioner shown in FIGS. 3A and 3B is manufactured as described below.

With the embodiment in FIGS. 3A and 3B, a Ni metal sheet of about 2 mm in thickness is used as the conducting metal sheet 15, and about 2,000 penetrating holes 15*a,* 0.5 mm in diameter, are bored in this metal sheet, and a diamond prism 12 is embedded in each hole.

Next, conducting metal powder is filled into the gaps between the penetrating holes 15*a* and the diamond prisms 12, and while the entire conducting metal sheet 15 is held at a high temperature in an inert gas environment, the metal powder is sintered, and a conducting sintered metal 16 that firmly holds the diamond prisms 12 is formed.

In this embodiment, the conducting metal sheet 15 is joined to a base metal 18 by soldering into one body. However, other means of joining, for instance diffusion joining can also be applied.

Figure 5:
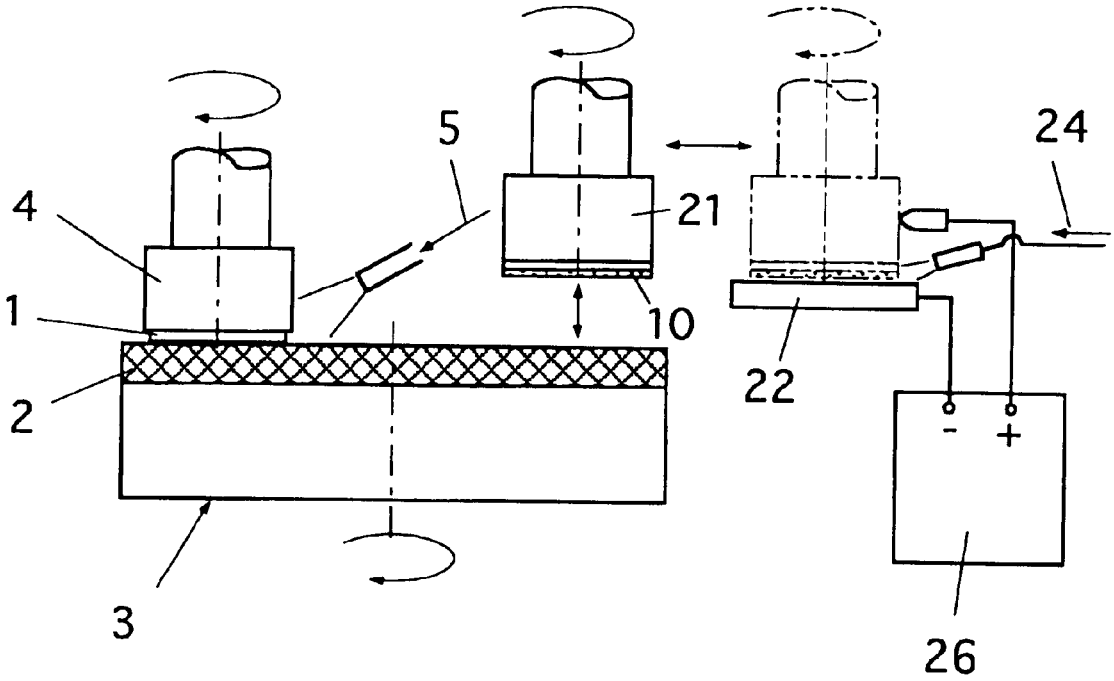
FIG. 5 is a diagram showing a CMP apparatus using a polishing pad conditioner according to the present invention.

FIG. 5 is a drawing that shows a CMP apparatus using the polishing pad conditioner according to the present invention. In this figure, the CMP apparatus, like the conventional CMP apparatus shown in FIG. 1, is provided with a rotating base plate disk 3 with a polishing pad mounted on the top surface thereof, and a rotating plate 4 with a silicon wafer 1 fixed on the lower surface of the plate, and while the disk 3 and the plate 4 are rotated around their respective axes, a slurry 5 containing colloidal silica is supplied between them, thus ultra-fine particles (with grains of several to several tens of nanometers in diameter) in the colloidal silica are made to react with the silicon wafer (Si), and at the same time, $SiO_2$ contained in the colloidal silica is retained on the polishing pad and polishes the lower surface of the silicon wafer 1.

The CMP apparatus in FIG. 5 is further provided with a second rotating spindle 21 with the polishing pad conditioner 10 of the present invention mounted on the lower surface thereof. The second rotating spindle 21 is arranged to be capable of moving in the vertical and horizontal directions while rotating around its axis. Furthermore, the apparatus is provided with an electrode 22 separate and opposite the conducting bonding member 14 (composed of the plate 15 and the sintered metal 16) of the polishing pad conditioner 10 at a location to which the second rotating spindle 21 can be moved in a horizontal direction (shown by the double chain line in FIG. 5), a conducting liquid feeder that feeds a conducting liquid 24 therebetween, and a power supply 26 that charges the member 14 and the electrode 22, positively and negatively, respectively.

Using this configuration, the polishing pad conditioner 10 is lowered and rotated while being pressed against the upper surface of the polishing pad 2, thereby the surface of the polishing pad is reprocessed (reconditioned) to an appropriate roughness, and whenever required, the second rotating spindle is offset in the horizontal direction, and the surface of the polishing pad can be dressed electrolytically by making the conducting liquid 24 flow between the conducting bonding member and the electrode 22 that is located opposite the member with a gap between them.

Figure 6:
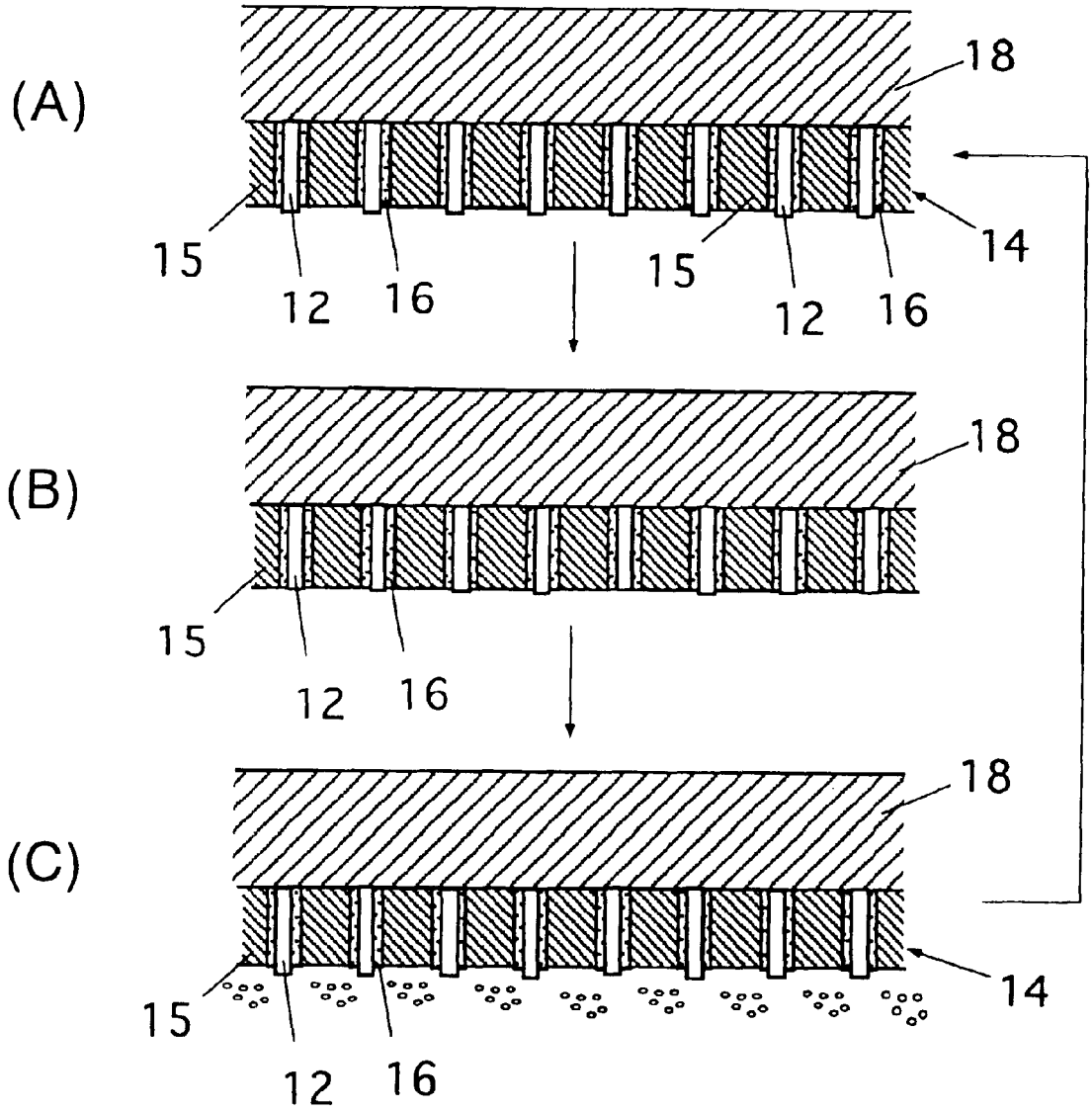
FIG. 6 is a diagram showing principle of the present invention.

FIG. 6 explains principles of the present invention. In this figure, (A) shows a section through the surface of the tool in the preferred condition for use as a polishing pad conditioner, wherein each diamond prism 12 protrudes evenly from the conducting bonding member 14 (composed of component parts 15 and 16). (B) shows the surface of the tool after the diamond prisms 12 have become worn, and (C) shows the protrusions of the diamond prisms 12 after being dressed electrolytically.

As the polishing pad is conditioned continuously using the polishing pad conditioner 10 shown in (A), the tips of the diamond prisms 12 wear. As shown in (B), when the protrusion of the diamond prisms 12 from the conducting bonding member 14 becomes insufficient, the conditioner becomes overloaded due to friction in the machining process, so that conditioning can no longer continue in a stable manner. To avoid this situation, some of the conducting bonding member 14 is removed electrolytically, so that the tip of each diamond prism 12 is again protruding from the conducting bonding member 14 while the surface of the tool is restored to the good condition of (A), as shown in (C).

By repeating operations (A) to (C), the surface of the tool can be maintained in the preferred state for a polishing pad conditioner at all times.

According to the aforementioned configuration of the present invention, because the conducting bonding member 14 that fixes the diamond prisms into a single body can be electrolytically dressed by passing a flow of conducting liquid 24 through the gap between it and the electrode 22 placed opposite, when the tips of the diamond prisms 12 become worn and the protrusions of the prisms from the conducting bonding member become so small that the conditioning capabilities are adversely affected, some of the surface of the conducting bonding member can be removed by the electrolytic dressing, and the protrusions of the diamond prisms can be increased. As a result, the amount of the protrusions can be optimized at all times so that the tips of the diamond prisms can function as cutting edges, the polishing pad (a plastic material, for example) can be reprocessed (reconditioned) to an appropriate roughness, and appropriate conditions can be maintained in a stable and even manner. Moreover, because artificial diamond prisms with a length of about 2 mm, for instance, can be used, the life can be made several tens of times longer than the thickness of conventional abrasive grains or thin films.

In addition, the conducting bonding member 14 is composed of the conducting metal plate 15 with a plurality of holes 15*a,* and the conducting sintered metal 16 filling the gaps between the holes and diamond prisms and sintered, and the conducting sintered metal 16 that firmly holds the diamond prisms 12 can be formed by inserting the diamond prisms 12 into the holes 15*a* and charging conducting metal powder into the spaces therebetween and sintering the powder. Therefore, the manufacturing cost can be greatly reduced compared to that of the slow-growing, expensive CVD systems. Furthermore, since the metal powder can be sintered by holding it at a high temperature in an inert gas environment, no impurities can be mixed in so that the silicon wafer can be protected from contamination.

However, the present invention shall not be limited only to the above-mentioned embodiments, instead, the present invention can be modified in various ways as long as the scope of the present invention is not exceeded. For instance, although the CMP apparatus (Chemical Mechanical Polishing Apparatus) for devices/bare silicon wafers was detailed above, the principles of the present invention can be directly applied also to other polishing apparatus.

As described above, the polishing pad conditioner according to the present invention can provide various advantages and effects such as the capability of reprocessing (reconditioning) the surface of a polishing pad to an appropriate roughness, providing a very long life maintaining stable, even conditioning, relatively low manufacturing costs and no risk of contaminating the silicon wafers.

Although the present invention has been described referring to several preferred embodiments, it is understood that the scope of rights included in the present invention should not be limited only to these embodiments. Instead, the scope of rights of the present invention shall include all modifications, corrections and equivalent entities contained in the scope of the attached claims.

What is claimed is:

1. A polishing pad conditioner comprising:

a plurality of diamond prisms arranged regularly in such a manner that tips thereof protrude towards a surface to be processed; and a conducting bonding member that fixes the diamond prisms into a single body, wherein the conducting bonding member can be dressed electrolytically by passing of a flow of conductive fluid through a gap between the member and an electrode placed opposite thereto, and wherein each diamond prism is constructed to have a square form.

2. The polishing pad conditioner specified in claim 1, in which the conducting bonding member comprises a conducting metal plate with a plurality of holes for embedding the diamond prisms, and a conducting sintered metal filled into a spaces between the holes and the diamond prisms and sintered therein.

3. The polishing pad conditioner specified in claim 1, wherein the conducting bonding member has the shape of a circular disk, and tips of the plurality of diamond prisms are positioned on a bottom surface of the circular disk.

4. A polishing pad conditioner comprising:

a plurality of diamond prisms arranged regularly in such a manner that tips thereof protrude towards a surface to be processed; and a conducting bonding member that fixes the diamond prisms into a single body, wherein the conducting bonding member comprises a conducting metal plate with a plurality of holes for embedding the diamond prisms, and a conducting sintered metal filled into a spaces between the holes and the diamond prisms and sintered therein, wherein the conducting bonding member can be dressed electrolytically by passing of a flow of conductive fluid through a gap between the member and an electrode placed opposite thereto.

* * * * *